United States Patent [19]

Guscott

[11] Patent Number: 4,906,976

[45] Date of Patent: Mar. 6, 1990

[54] INFRARED DETECTOR

[75] Inventor: John K. Guscott, Stow, Mass.

[73] Assignee: Aritech Corporation, Framingham, Mass.

[21] Appl. No.: 170,269

[22] Filed: Mar. 18, 1988

[51] Int. Cl.[4] ..... G08B 13/18

[52] U.S. Cl. ..... 340/567; 250/338.3; 250/342

[58] Field of Search ..... 340/567; 250/338.3, 250/342

[56] References Cited

U.S. PATENT DOCUMENTS

| | | | |
|---|---|---|---|
| 3,839,640 | 10/1974 | Rossin | 250/353 |
| 3,958,118 | 5/1976 | Schwarz | 340/567 |
| 4,225,786 | 9/1980 | Perlman | 250/349 |
| 4,321,594 | 3/1982 | Galvin et al. | 340/567 |
| 4,339,748 | 7/1982 | Guscott et al. | 250/342 |
| 4,342,987 | 8/1982 | Rossin | 340/567 |
| 4,343,987 | 8/1982 | Schimbke et al. | 219/287 |
| 4,364,030 | 12/1982 | Rossin | 340/567 |
| 4,375,034 | 2/1983 | Guscott | 340/567 |
| 4,514,631 | 4/1985 | Guscott | 250/342 |
| 4,707,604 | 11/1987 | Guscott | 250/342 |
| 4,769,545 | 9/1988 | Fraden | 340/567 |
| 4,800,278 | 1/1989 | Taniguti et al. | 250/338.3 |

*Primary Examiner*—Glen R. Swann, III

*Attorney, Agent, or Firm*—Weingarten, Schurgin, Gagnebin & Hayes

[57] ABSTRACT

An improved passive infrared balanced detector is disclosed that reduces false alarm rates induced from random thermal activity and other causes of splitting of the field(s) of view of the balanced detector into distinct and independent regions. The detector includes balanced elements selectively shaped and arranged to provide common mode rejection within each of the regions into which the field(s) of view are subject to being split. The unbalance susceptibility of the novel detectors may be adapted to the particular requirements of the intended applications environment. The susceptibility for unbalance is materially reduced and therewith the alarm confidence level of the detectors is substantially improved.

6 Claims, 3 Drawing Sheets

INFRARED DETECTOR

FIELD OF THE INVENTION

The present invention is directed to the field of remote sensing, and more particularly, to new and improved infrared detectors.

BACKGROUND OF THE INVENTION

Passive intruder detection systems are widely employed to detect the presence and movement of an intruder in a protected region. In the typical case, optics, operatively associated with an infrared detector, provide one or more fields of view which image infrared energy onto the active sensing element of the detector. The detector is operative in response to the thus received infrared energy to provide a signal indication of a possible intruder.

The confidence level of the security system critically depends on the ability to reliably distinguish true intruder events from false alarm producing events in the operative locale of the sensor. Thermal activity in the fields of view of the infrared detector is particularly troublesome, as space heaters, animals, and other warm objects induce false alarms as well as air convection, sunlight with cloud motion, and other kinds of thermal instabilities.

Dual element balanced detectors, for example as disclosed in U.S. Pat. Nos. 4,364,030, 3,839,640, 4,343,987, 4,514,631, and 4,707,604, each incorporated herein by reference, provide "common mode" rejection of randomly varying thermal noise. These detectors have dual elements that produce opposite polarity electrical signals when exposed to thermal activity. The signals are combined, and randomly varying signals are self-cancelling over time.

Detectors based on the principle of common mode thermal noise rejection are subject to degraded performance to the extent that one or the other element of the dual element balanced detectors is viewing a dissimilar background from the other element. The elements exposed to dissimilar backgrounds are effectively prevented from producing self-cancelling signals, whereby the detectors are subjected to false alarms. Typically, the fields of view are subject to splitting into dissimilar backgrounds by furniture or a wall in the surveillance zone. While installers are usually cautioned to avoid placing the detectors in positions where any one or more of their associated fields of view could become split, in point of fact for many installations it is often difficult or impossible to do so.

SUMMARY OF THE INVENTION

The present invention contemplates as its principal object a passive intrusion detection system substantially free from thermal activity induced false alarms, and discloses a detector having two or more elements that receives infrared energy from one or more fields of view. The elements are so shaped, arranged and connected as to provide common mode rejection symmetrically about multiple axes along which the one or more fields of view are potentially subject to being split into dissimilar regions so that randomly varying thermal events present in any region produce self-cancelling signals notwithstanding actual splitting of the one or more fields of view. Various preferred embodiments are disclosed of a dual element balanced assembly including an interdigited triad of linear sensing fingers, an interdigited triad of linear fingers two of which are U-shaped, and an interdigited pentad of linear sensing fingers. The elements in each of the embodiments are connected to provide common mode rejection and are so symmetrically arranged that multiple phase opposition elements respectively view the regions into which the fields of view are subject to being split.

BRIEF DESCRIPTION OF THE DRAWINGS

These and other objects, aspects and advantages of the present invention will become apparent as the invention becomes better understood by referring to the following solely exemplary and non-limiting detailed description of the preferred embodiments thereof, and to the drawings, wherein.

DETAILED DESCRIPTION OF THE PREFERRED EMBODIMENTS

Figure 1:
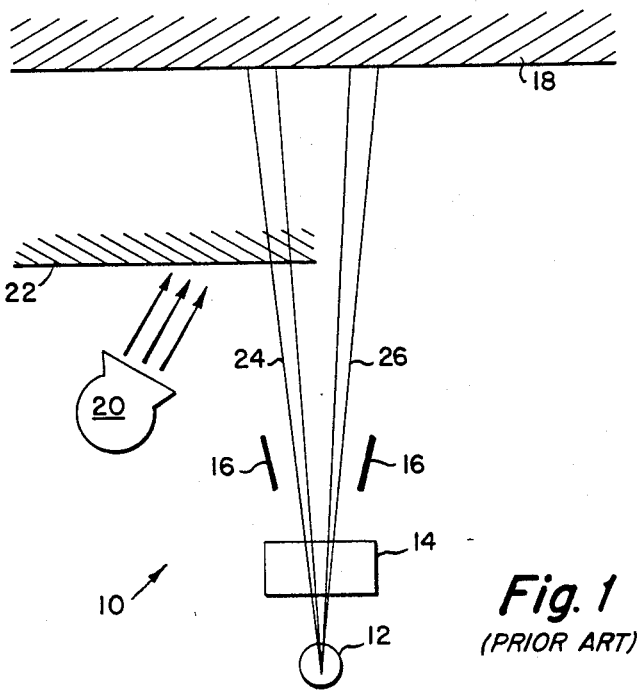
Fig. 1 (PRIOR ART)
FIG. 1 is a plan pictorial diagram illustrating how a split field of view subjects a conventional balanced infrared intrusion detection system to false alarms.

Referring now to FIG. 1, generally designated at 10 is a plan pictorial diagram illustrating an exemplary mode by which the heretofore known balanced infrared detectors are subjected to false alarms due to undesired field of view splitting. An infrared balanced detector 12 has two sensing elements connected in electrical phase opposition to provide common mode rejection of randomly varying thermal noise. So long as each element of the balanced detector is viewing energy arising from the same field of view, the elemental signals are equal but opposite in phase and average out over time. But if the field of view is "split", and each element "sees" energy from a dissimilar background, such as by the presence of an actual physical obstruction or by some thermal event that acts locally within a part of the field of view but not in another part thereof, then the balanced detector, the elements thereof being exposed to different backgrounds, is subjected to false alarms.

Optics 14 of any type well known to those skilled in the art are associated with the sensor 12 to image infrared energy present in the surveillance region onto the elements of the sensor. Any suitable infrared sensing materials may be employed, such as thickness poled PZT, lithium tantalate, and polyvinylidine fluoride, among others. The optics 14 may provide fields of view that include vertical "curtains" of surveillance that are comparatively narrow in azimuthal angle and comparatively wide in elevational angle, as in U.S. Pat. No.

4,375,034, incorporated herein by reference, and "finger" beams that focus energy present in comparatively narrow azimuthal and elevational angles, as in U.S. Pat. No. 4,339,748, incorporated herein by reference, among others. The optics 14 can be selected to provide one or more fields of view in one or more beam patterns to accommodate the requirements of the particular region to be protected. In FIG. 1, the optics 14 provides an exemplary vertical curtain of protection schematically illustrated by the marks 16. So long as each element of the sensor 12 is viewing the same background schematically illustrated hatched at 18, common mode noise rejection is provided, and randomly varying thermal noise is cancelled within the field of view 16.

A fan 20 for example if present within the field of view 16 of the sensor 12 could appear to the sensor 12 as if it were a background schematically illustrated in hatched outline 22 obstructing the background 18. The thermal gradient produced by the fan 20 locally within the field of view 16 of the sensor 12 affects but one element of the detector and not the other element of the detector. The field of view 16 is then "split" between the elements of the sensor, one of the elements seeing the background 22 as schematically illustrated at 24 and the other of the elements of the balanced detector seeing the background 18 as schematically illustrated at 26, thereby precluding common mode thermal noise rejection.

Figure 2A:
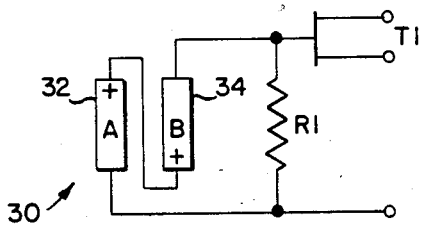
Fig. 2A (PRIOR ART)
FIG. 2 illustrates in FIG. 2A thereof a schematic circuit diagram of a prior art detector, and illustrates in FIG. 2B thereof a graph useful in explaining the false alarm susceptability of the FIG. 2A prior art detector.

Referring now to FIG. 2A, generally designated at 30 is a circuit schematic of a typical prior art balanced detector. The detector 30 includes equal area pyroelectric elements 32, 34 serially connected in electrical phase opposition that are in parallel with a resistor designated R1 and connected to the gate of an FET buffer amplifier designated T1. Random thermal fluctuations tend to produce equal and opposite signals in the phase opposed detector elements 32, 34 whereby they tend to average to zero thereby preventing false alarms.

Figure 2B:
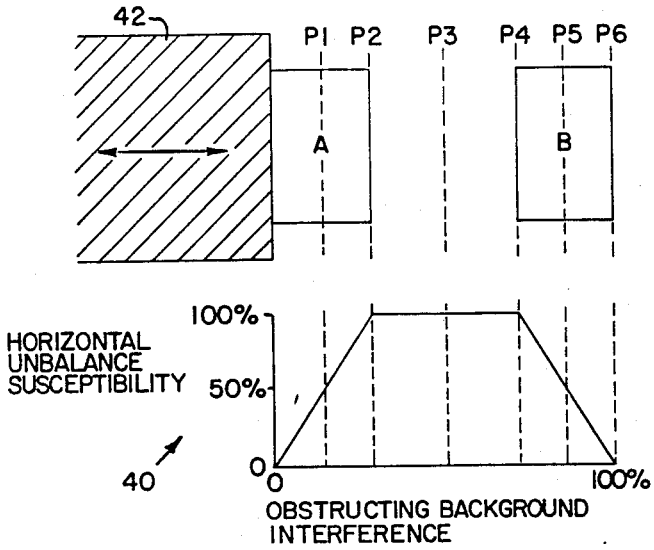
Fig. 2B (PRIOR ART)

Referring now to FIG. 2B, generally designated at 40 is a graph useful in explaining the false alarm susceptibility of the prior art balanced detector 30 (FIG. 2A), where "unbalance susceptibility" is the ordinate value and "obstructing horizontal background interference" is the value of the abscissa. The "unbalance susceptibility" is a measure of the potential of a balanced detector to provide a false alarm when the elements of the detector are unbalanced by virtue of the elements viewing dissimilar fields of view, and it is proportional to the extent that the effective area of either of the elements views a field of view dissimilar from the other element.

The detector elements are designated "A" and "B". The elements are intended to share the same field of view, but the field of view is subject to being split into regions along axes of symmetry in which dissimilar energy is present whereby false alarms are induced due to common mode failure in each of the regions. To illustrate the unbalance susceptibility along an elevational symmetry axis, it is useful to consider an obstructing background 42 as it variably occludes the field of view of the elements of the detector by occupying the horizontal positions designated "P1 through P6" successively. For each position, the field of view is split along an elevational axis parallel the elevational symmetry axis into distinct and independent regions to its left and to its right. As shown by the illustrated position of the background 42, i.e. when both elements view the same field of view, the susceptibility to unbalance of the detector is zero percent. At the position P1 of the background, fifty percent of the element "A" views one background while the remaining portion thereof views a different background, which is in common with the element "B", producing thereby an unbalance susceptibility of fifty percent, as illustrated. In the positions P2, P3 and P4 of the obstructing background 42, the field of view is so split that the entire area of the element "A" is viewing one region while the element "B" is viewing an entirely different region. The detector is then completely unbalanced, with one hundred percent of the effective area of one element of the balanced detector viewing a background dissimilar from that of the other element, thereby yielding a one hundred percent unbalance susceptibility as shown in FIG. 2B. For the position P5, the field splitting produces the value of unbalance susceptibility indicated, which, being analyzable as the corresponding position P1, is not further discussed herein for the sake of brevity of explication. At position P6, elements "A" and "B" would both be viewing the same obstructing background 42, i.e., the 100% abscissa position, such that the unbalance susceptibility would be zero.

Figure 3A:
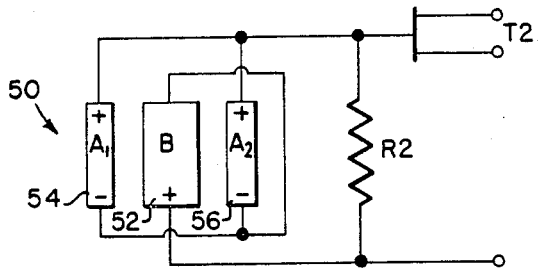
FIG. 3 illustrates in FIG. 3A thereof a schematic circuit diagram illustrating one embodiment of a detector constructed in accordance with the present invention, and illustrates in FIG. 3B thereof a graph useful in explaining the improved performance of the novel FIG. 3B detector.

Referring now to FIG. 3, generally designated at 50 in FIG. 3A is a circuit diagram illustrating one embodiment of an improved infrared detector according to the present invention. The detector 50 includes two equal-area balanced detector elements 52, and 54, 56. The element 52 is connected in series phase opposition with the elements 54, 56, these later being themselves connected in parallel. A biasing resistor designated "R2" is connected in parallel across the balanced detector elements 52 and 54, 56, and the gate of an FET buffer amplifier designated "T2" is connected to the resistor R2.

The elements 52 and 54, 56 are of equal area, are shaped as rectangles preferably with a six to one aspect ratio, and exhibit left—right and top—bottom symmetries.

Figure 3B:
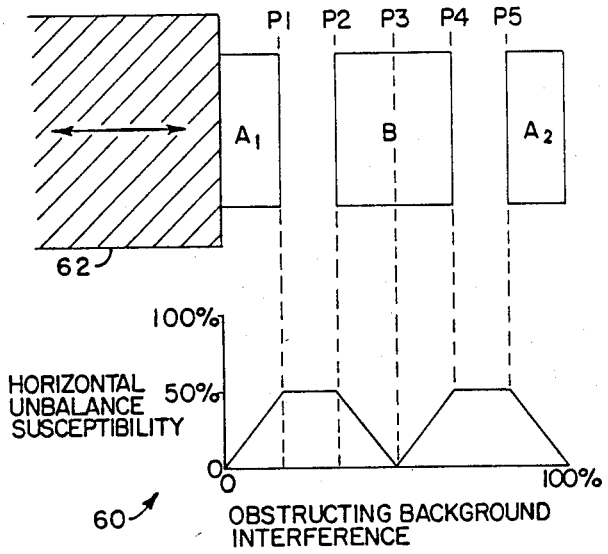

Referring now to FIG. 3B, generally designated at 60 is a graph which plots "horizontal unbalance susceptibility" as the ordinate value and "obstructing background interference" as the abscissa value. The detector elements are designated "A1", "A2", "B". The field of view thereof is subject to being split into dissimilar regions defined to either side of any elevational axis parallel to an elevational symmetry axis, as for the exemplary positions designated "P1 through P5" of a hypothetical obstructing background 62. For the illustrated position of the background 62, both elements A1, A2, and B see the same field of view, so that they produce balanced electrical signals, and a zero percent horizontal unbalance susceptibility. For splitting of the field of view about the axis P2 corresponding to the obstructing background 62 totally occluding the field of view of the detector split element A1, the element B, and the split element A2, view a background dissimilar from that viewed by the split element A1. For this case, one-half of the effective area of the detector elements view dissimilar backgrounds, as illustrated by the fifty percent value of the horizontal unbalance susceptibility corresponding thereto. At the position P3, corresponding to splitting about the elevational symmetry axis, the field of view is so split that the entire area of the split element A1 is viewing one region while the element "A2" is viewing an entirely different region. The element "B" is split into two halves, each half viewing the same background as corresponding ones of the split elements "A1" and "A2". The detector is then completely balanced, with zero percent of the effective area of one element of the balanced detector viewing a background dissimilar from that of the other element. The detector thus exhibits common mode rejection and has the illustrated unbalanced susceptibility of zero. The other positions P4 and P5, and positions intermediate the indicated positions, exhibit the unbalance susceptibilities illustrated, but are not separately described for brevity of explication.

The area under the graphs is representative of the total horizontal unbalance susceptibility for field splitting into regions defined with respect to all elevational axes parallel to and including the elevational symmetry axis. The element shape, arrangement and spacing are selected to provide any intended degree of total horizontal (elevational splitting) unbalance susceptibility for a given applications environment. As will be readily appreciated by comparing the areas of the graphs of FIGS. 2B and 3B, the FIG. 3B embodiment of the detector constructed in accordance with the present invention exhibits substantially lower overall false alarm rates than that of the FIG. 2A embodiment constructed in accordance with the prior art.

For splitting from top-to-bottom and corresponding separation into regions about axes parallel to and including the azimuthal symmetry axis, an obstructing background, not shown, would always occlude equal areas of both of the elements of the balanced detector, so that the vertical (azimuthal) unbalance susceptibility with respect to separation into regions to either side of an axis parallel to the azimuthal symmetry axis is accordingly equal to zero percent, no matter where the splitting axis is positioned from top-to-bottom. For axis orientations other than parallel to either the elevational symmetry axis or the azimuthal symmetry axis other unbalance susceptibilities obtain as will readily be appreciated by those skilled in the art.

Figure 4:
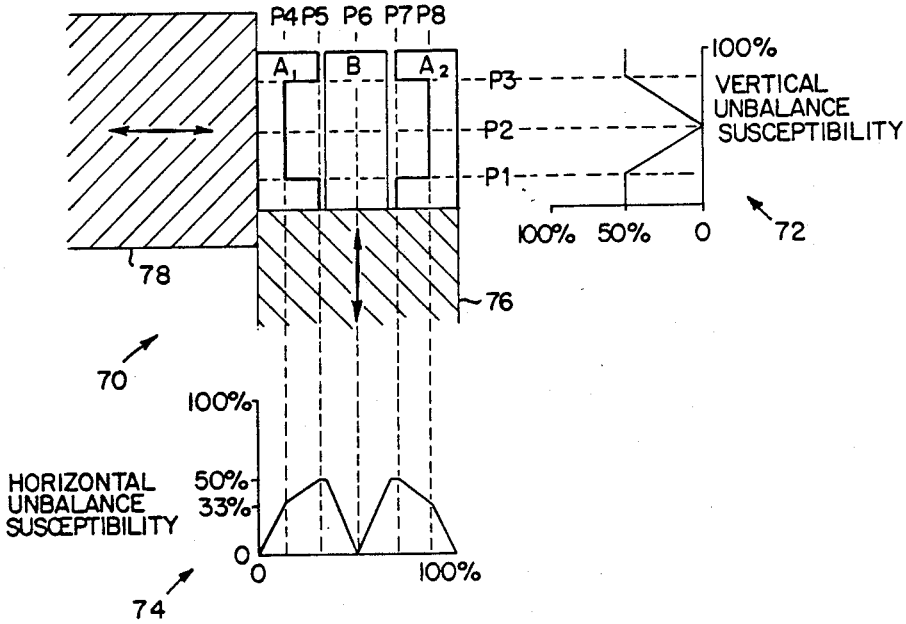
FIG. 4 is a diagram useful in explaining the false alarm susceptibility of another embodiment of a detector constructed in accordance with the present invention.

Referring now to FIG. 4, generally designated at 70 is another embodiment of an improved infrared detector constructed in accordance with the present invention. The detector 70 includes an element designated "A1" and an element designated "A2" symmetrically disposed in spaced-apart relation to either side of an element designated "B". The element "B" and the element "A1, A2" have equal areas, and are, as in the embodiment shown in FIG. 3A, electrically connected such that the element "B" is in series phase opposition to parallel connected elements "A1, A2". The differences between the embodiment of FIG. 4 and that of FIG. 3 is the elements "A1, A2" (FIG. 4) have a generally U-shape and the elements "A1, A2" and "B" (FIG. 4) are less spread apart laterally and so are closer together than the elements of the FIG. 3 embodiment. The selected shape, spacing and arrangement of the FIG. 4 embodiment are selected to provide intended vertical and horizontal unbalance susceptibilities generally designated at 72 and at 74. The field of view is subject to being split into regions defined to either side of any azimuthal axis parallel to and including the azimuthal symmetry axis, as shown by the exemplary positions designated "P1 through P3" of hypothetical obstructing background 76, and is subject to being split into regions defined to either side of any elevational axis defined to either side of the elevational symmetry axis, as shown by the exemplary positions designated "P4 through P8" of an obstructing background 78. The obstructing backgrounds 76, 78 as they respectively subtend the field of view of the elements A1, A2, and B in the several positions "P1 through P8" produce the given values of the corresponding vertical and horizontal unbalance susceptibilities in the same manner as that described above with respect to the description of the FIG. 3 embodiment, and are not further described for the sake of brevity of explication. It is to be noted that the areas under the graphs for the embodiment of FIG. 4, respectively representative of the overall unbalance susceptibility against elevational and azimuthal field splitting, indicates that the detector embodiment of FIG. 4 has a lower overall unbalance susceptibility for horizontal obstruction (elevational axis splitting) than that for the detector of the embodiment illustrated in FIG. 3, and a higher overall unbalance susceptibility for vertical obstruction (azimuthal symmetry axis splitting) than that for the detector of FIG. 3, whereby the FIG. 4 detector may with advantage be deployed in those applications where it is more likely than not that splitting of the detector element fields of view would occur into regions defined by the elevational rather than azimuthal symmetry axis.

Figure 5:
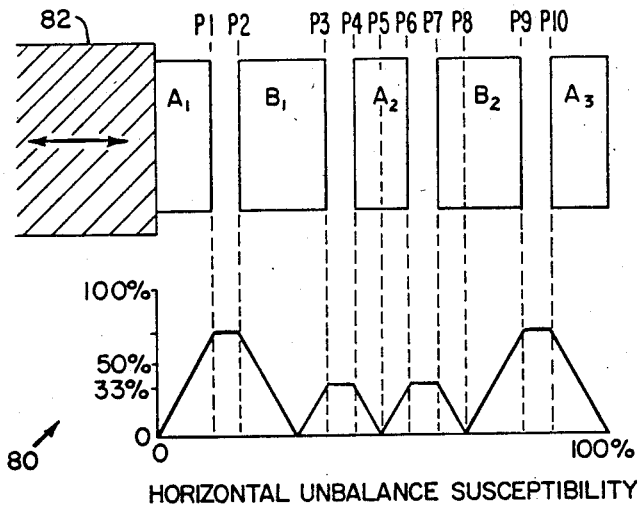
FIG. 5 is a diagram useful in explaining the false alarm susceptibility of yet another embodiment of a detector constructed in accordance with the present invention.

Referring now to FIG. 5, generally designated at 80 is another embodiment of an improved infrared detector according to the present invention. The detector 80 includes two elements, designated "A1, A2, A3" and "B1, B2" connected in phase opposition, each of which consists of multiple parts, which are electrically connected in parallel. Again, as for the other embodiments, the elements have equal areas when the several parts thereof are added together. Parts B1, B2 are interdigited and spaced apart with the parts A1, A2, and A3 in such a way as to exhibit left—right and up—down symmetries. The parts are preferably rectangularly shaped, and preferably have a six to one aspect ratio. The horizontal unbalance susceptibility for the detector of the FIG. 5 embodiment is plotted for a hypothetical obstructing background 82 that occupies the positions designated "P1 through P10" and intermediate and terminal points, values for which, being obtained in a manner identical to that for the graphs described above in connection with the description of the embodiments of FIGS. 3 and 4, is not explained again for the sake of brevity of explication.

It will be appreciated by those skilled in the art that the principles of the present invention underlie detector geometries of widely differing configurations including a nested configuration. Accordingly, particular embodiments disclosed herein should only be considered as examples of detectors embodying the present invention but not as being limiting thereof. The principles of the instant invention may with advantage be applied not only to single balanced detectors, as described herein, but also to so-called "twin duals" or "quad element" detectors. The principles of the present invention are applicable in general to any class of passive detector other than infrared detectors that is susceptible to unbalance due to splitting of its detectors' fields of view.

Many modifications of the presently disclosed invention will become apparent to those skilled in the art so that the invention is not to be limited except by the scope of the appended claims.

What is claimed is:

1. A passive infrared balanced detector for monitoring a surveillance region, comprising:

optical means for providing at least one field of view for monitoring infrared energy in the surveillance region, said at least one field of view being subject to splitting into dissimilar viewing subregions wherein infrared energy from the dissimilar viewing subregions may be unequal, thereby causing false alarms in said passive infrared balanced detector, and wherein the dissimilar viewing subregions are defined with respect to azimuthal and elevational symmetry axes of said passive infrared balanced detector; and passive balanced sensor means cooperative with said optical means for monitoring infrared energy in the surveillance region, said passive balanced sensor means including first and second sensing elements electrically connected in series phase opposition, said first and second sensing elements having predetermined shapes and equal areas and at least one of said first and second sensing elements further comprising a plurality of discrete sensing subelements of equal area connected in parallel, said equal areas of said plurality of discrete sensing subelements in combination equaling said area of the other of said first and second sensing elements; and wherein said first and second sensing elements are symmetrically disposed in spaced apart relation with respect to one another and at least one of said first and second sensing elements is orientated in a predetermined symmetrical relation on said azimuthal and elevational symmetry axes of said passive infrared balance detector to provide predetermined vertical and horizontal unbalance susceptibilities for said passive infrared balanced detector.

2. The passive infrared balanced detector of claim 1 wherein said first sensing element comprises said plurality of discrete sensing subelements and further wherein said plurality of discrete sensing subelements is a pair of discrete sensing subelements having predetermined shapes and equal areas, said equal areas of said pair of discrete sensing subelements in combination being equal to said area of said second sensing element, said pair of discrete sensing subelements being electrically connected in parallel with one another and in series phase opposition with said second sensing element, and wherein said second sensing element is symmetrically orientated on said azimuthal and elevational symmetry axes of said passive infrared balanced detector and said pair of discrete sensing subelements are symmetrically disposed with respect to said elevational symmetry axis in spaced apart relation a predetermined distance to either side of said second sensing element to provide said predetermined vertical and horizontal unbalance susceptibilities for said passive infrared balanced detector.

3. The passive infrared balanced detector of claim 2 wherein said predetermined shapes of said pair of discrete sensing subelements and said second sensing element are rectangular shapes.

4. A passive infrared balanced detector for monitoring a surveillance region, comprising:

optical means for providing at least one field of view for monitoring infrared radiation in the surveillance region, said at least one field of view being subject to splitting into dissimilar viewing subregions wherein infrared energy from the dissimilar viewing subregions may be unequal, thereby causing false alarms in said passive infrared balanced detector, and wherein the dissimilar viewing regions are defined with respect to azimuthal and elevational symmetry axes of said passive infrared balanced detector; and passive balanced sensor means cooperative with said optical means for monitoring infrared energy in the surveillance region, said passive balanced sensor means including first and second discrete sensing elements electrically connected in series phase opposition, said first and second discrete sensing elements having predetermined shapes and equal areas, said first discrete sensing element comprising a pair of discrete sensing subelements having predetermined shapes and equal areas and wherein said predetermined shape of said second discrete sensing element is a rectangular shape and said predetermined shapes of said pair of discrete sensing subelements are U-shaped, said equal areas of said pair of discrete sensing subelements in combination being equal to said area of said of said second discrete sensing element, said pair of discrete sensing subelements being electrically connected in parallel with one another and in series phase opposition with said second discrete sensing element; and wherein said first and second discrete sensing elements are symmetrically disposed in spaced apart relation with respect to one another and at least one of said first and second discrete sensing elements is orientated in a predetermined symmetrical relation on said azimuthal and elevational symmetry axes of said passive infrared balanced detector, and wherein said second discrete sensing element is symmetrically orientated on said azimuthal and elevational symmetry axes of said passive infrared balanced detector and said pair of discrete sensing subelements are symmetrically disposed with respect to said elevational symmetry axis in spaced apart relation a predetermined distance to either side of said second discrete sensing element to provide predetermined vertical and horizontal unbalance susceptibilities for said passive infrared balanced detector.

5. A passive infrared balanced detector for monitoring a surveillance region, comprising:

optical means for providing at least one field of view for monitoring infrared radiation in the surveillance region, said at least one field of view being subject to splitting into dissimilar viewing subregions wherein infrared energy from the dissimilar viewing subregions may be unequal, thereby causing false alarms in said passive infrared balanced detector, and wherein the dissimilar viewing regions are defined with respect to azimuthal and elevational symmetry axes of said passive infrared balanced detector; and passive balanced sensor means cooperative with said optical means for monitoring infrared energy in the surveillance region, said passive balanced sensor means including first and second discrete sensing elements electrically connected in series phase opposition, said first and second discrete sensing elements having predetermined shapes and equal areas and wherein said first discrete sensing element comprises a triad of discrete sensing subelements having predetermined shapes and equal areas and said second discrete sensing element comprises a pair of discrete sensing subelements having predetermined shapes and equal areas, said equal areas of said triad of discrete sensing subelements in combination being equal to said equal areas of said pair of discrete sensing subelements in combination, said triad of discrete sensing subelements being electrically connected in parallel with one another, said pair of discrete sensing subelements being electrically connected in parallel with one another, and said triad of discrete sensing subelements being electrically connected in series phase opposition with said pair of discrete sensing subelements, and wherein said first and second discrete sensing elements are symmetrically disposed in spaced apart relation with respect to one another and at least one of said first and second discrete sensing elements is orientated in a predetermined symmetrical relation on said azimuthal and elevational symmetry axes of said passive infrared balanced detector, and wherein one of said triad of discrete sensing subelements is symmetrically orientated on said azimuthal and elevational symmetry axes of said passive infrared balanced detector, said pair of discrete sensing subelements are symmetrically disposed with respect to said elevational symmetry axis in spaced apart relation a first predetermined distance to either side of said one of said triad of discrete sensing subelements and said others of said triad of discrete sensing subelements are symmetrically disposed with respect to said elevational symmetry axis in spaced apart relation a second predetermined distance to either side of corresponding ones of said pair of discrete sensing subelements to provide said predetermined vertical and horizontal unbalance susceptibilities for said passive infrared balanced detector.

6. The passive infrared balanced detector of claim 5 wherein said predetermined shapes of said triad of discrete sensing subelements and said pair of discrete sensing subelements are rectangular shapes.

* * * * *